US007127875B2

(12) United States Patent
Cheung

(10) Patent No.: US 7,127,875 B2
(45) Date of Patent: Oct. 31, 2006

(54) PORTABLE VACUUM DEVICE

(75) Inventor: George F. Cheung, La Mirada, CA (US)

(73) Assignees: Intelli Innovations Ltd., Kowloon (HK); Serene Innovations, Norwalk, CA (US)

( * ) Notice: Subject to any disclaimer, the term of this patent is extended or adjusted under 35 U.S.C. 154(b) by 81 days.

(21) Appl. No.: 10/970,476

(22) Filed: Oct. 19, 2004

(65) Prior Publication Data

US 2005/0039421 A1 Feb. 24, 2005

(51) Int. Cl.
*B65B 31/04* (2006.01)

(52) U.S. Cl. ..... 53/510; 53/84; 53/88

(58) Field of Classification Search ..... 53/79, 53/84, 88, 111 R, 510, 512, 432, 433; 200/81 R, 200/83 S, 82 A
See application file for complete search history.

(56) References Cited

U.S. PATENT DOCUMENTS

| | | | | |
|---|---|---|---|---|
| 2,899,516 | A * | 8/1959 | Smith | 200/81 R |
| 3,648,740 | A * | 3/1972 | Pruitt | 141/8 |
| 3,688,064 | A * | 8/1972 | Myers | 200/83 N |
| 4,334,131 | A * | 6/1982 | Cooper et al. | 200/82 R |
| 4,941,310 | A * | 7/1990 | Kristen | 53/512 |
| 5,121,590 | A * | 6/1992 | Scanlan | 53/510 |
| 5,195,427 | A * | 3/1993 | Germano | 99/472 |
| 5,215,445 | A * | 6/1993 | Chen | 417/313 |
| 5,263,520 | A * | 11/1993 | Arai | 141/65 |
| 5,287,680 | A * | 2/1994 | Lau | 53/512 |
| 5,765,608 | A * | 6/1998 | Kristen | 141/198 |
| 6,410,870 | B1 * | 6/2002 | Nishizaki et al. | 200/83 R |
| 6,520,071 | B1 * | 2/2003 | Lanza | 99/472 |
| 6,799,506 | B1 * | 10/2004 | Tarlow | 99/472 |
| 2003/0110741 | A1 * | 6/2003 | Wang | 53/512 |
| 2003/0182900 | A1 * | 10/2003 | Bowden et al. | 53/432 |
| 2004/0065051 | A1 * | 4/2004 | Patterson et al. | 53/432 |

* cited by examiner

*Primary Examiner*—Stephen F. Gerrity
*Assistant Examiner*—Paul Durand
(74) *Attorney, Agent, or Firm*—Raymond Y. Chan; David and Raymond Patent Firm

(57) ABSTRACT

A portable vacuum device for extracting fluid in a container having an opening includes a handheld housing, a fluid extracting nozzle, a vacuum device and a sensor switch. The fluid extracting nozzle has a vacuum pressure corresponding to an interior pressure of the container, extended towards the handheld housing for communicating with the opening of the container. The vacuum device is supported in the handheld housing to generate a vacuum effect within the fluid extracting nozzle. The sensor switch includes a movable conductive member driven with respect to the vacuum pressure of the fluid extracting nozzle and a control member normally positioned spaced apart from the movable conductive member to allow the vacuum device to be operated, wherein when the vacuum pressure drops below a predetermined threshold pressure, the movable conductive member is driven to electrically contact with the control member to deactivate the vacuum device.

3 Claims, 9 Drawing Sheets

PORTABLE VACUUM DEVICE

BACKGROUND OF THE PRESENT INVENTION

1. Field of Invention

The present invention relates to sealing equipment, and more particularly to a portable vacuum device which has enhanced efficiency, is smaller in size, and is more convenient for utilization.

2. Description of Related Arts

Conventional sealing equipments, such as vacuum devices, have been extensively utilized for a wide variety of purposes, such as domestic vacuum sealing of storage bag which contains food. In the absence of air within the storage bag, the amount of micro-organisms would be kept minimum and therefore the extent to which the food stored in the bag would be contaminated by such micro-organisms can also be kept minimum. Thus, the food can be preserved for a longer period of time.

A conventional vacuum device comprises an operation housing defining a vacuum chamber wherein a plastic bag containing the product which is to be sealed is placed into the vacuum chamber. The air inside the plastic bag is then extracted and a heat sealer is installed for sealing the opening of the plastic bag. Due to the bulky size of the vacuum chamber, it is certainly not preferable for use in a confined domestic environment.

Over the years, in order to cater for the above problem, handheld vacuum device has been developed which comprises a vacuum housing communicating with a vacuum nozzle which is adapted to insert into the opening of the plastic bag for extracting air therein.

A common problem associated with such a handheld vacuum device is that it is very inconvenient during practical use. First of all, the handheld vacuum device needs some sorts of filtering to block unwanted particles or liquid droplets which have already retained in the plastic bag from entering to the vacuum pump. As a result, it is inconvenient to use in that it may require frequent replacement of filters.

Moreover, conventional handheld vacuum device usually comprises a vacuum sensor provided in the vacuum housing and electrically communicated with the vacuum pump for detecting the air pressure inside the plastic bag so as to automatically stop extracting air by the vacuum pump when all the air in the plastic bag has been extracted. The problem of this is that the performance of the sensor is often far from satisfactory so that the timing at which the vacuum pump stops operating does not match with the optimal air extraction inside the plastic bag. As a result, it may be that the vacuum pump is directed to stop extracting air when in fact the plastic bag is not become completely vacuum. Conversely, too insensitive the vacuum sensor leads to a result that the vacuum pump continues working when all the air inside the plastic bag has actually been extracted. Further vacuuming would lead to possible damage to the product contained in the plastic bag.

An example conventional art is that of U.S. Pat. No. 5,765,608 of Kristen, in which a vacuum device was disclosed as comprising a housing, a pump, a motor, and a vacuum sensor comprising a membrane. In that disclosure, a fluid flow tube is provided for fluid transfer and it allow the fluid to access to the vacuum sensor so as to optimally shut the motor off when a predetermined pressure inside the container is reached. A major problem for this conventional art is that the fluid flow tube plays a central role for fluid transfer within the vacuum device. This means that the positions of the relevant components, such as that of the motor, the pump, and the vacuum sensor, are dependent on the route and geometry of the fluid flow tube, which is elongated in shape. Specifically, the relevant components have to be distributed alone the fluid flow tube, making it very difficult to reduce the overall size of the housing.

Moreover, since the fluid flow tube is elongated in shape, from a practical perspective, it cannot be reasonably expected that along the fluid flow tube the fluid pressure is identical. As a result, the position of the vacuum sensor along the fluid flow tube becomes crucial in accurately assessing the fluid pressure at the container so as to determine an optimal time to stop vacuuming. However, it is very difficult, if not practically impossible, to find out an optimal position along the fluid flow tube for installing the vacuum sensor so as to achieve an optimal performance of the vacuum device.

SUMMARY OF THE PRESENT INVENTION

A main object of the present invention is to provide a portable vacuum device with enhanced efficiency, is smaller in size, and is more convenient for utilization.

Another object of the present invention is to provide a portable vacuum device which comprises a vacuum sensor adapted for accurately detecting the fluid pressure of a container from which the vacuum device extracts fluid, so as to optimize an operation of the present invention, i.e. automatic stop extracting fluid when the container has become vacuum.

Another object of the present invention is to provide a portable vacuum wherein the relative positions of all the components are not dependent upon a single fluid flow tube, such that the distribution of those components inside a handheld housing can be arranged to form a compact structure as compared with the above-mentioned conventional art.

Another object of the present invention is to provide a portable vacuum device which does not involve expensive and complicated electrical or mechanical components so as to minimize the manufacturing cost and the ultimate selling price of the present invention.

Accordingly, in order to accomplish the above objects, the present invention provides a portable vacuum device for extracting fluid in a container having an opening, comprising:

- a handheld housing having a vacuuming head;
- a fluid extracting nozzle, having a vacuum pressure corresponding to an interior pressure of the container, extended towards the vacuuming head for communicating with the opening of the container;
- a vacuum device supported in the handheld housing to generate a vacuum effect within the fluid extracting nozzle at the vacuuming head of the handheld housing for extracting the fluid in the container; and
- a sensor switch, which is electrically connected between the vacuum device and the fluid extracting nozzle to sense the vacuum pressure at the fluid extracting nozzle, comprising a movable conductive member driven with respect the vacuum pressure of the fluid extracting nozzle and a control member normally positioned spaced apart from the movable conductive member to allow the vacuum device to be operated, wherein when the vacuum pressure drops below a predetermined threshold pressure, the movable conductive member is driven to electrically contact with the control member to form an open circuit of the vacuum device so as to deactivate the vacuum device from generating the vacuum effect.

These and other objectives, features, and advantages of the present invention will become apparent from the following detailed description, the accompanying drawings, and the appended claims.

DETAILED DESCRIPTION OF THE PREFERRED EMBODIMENT

Figure 1:
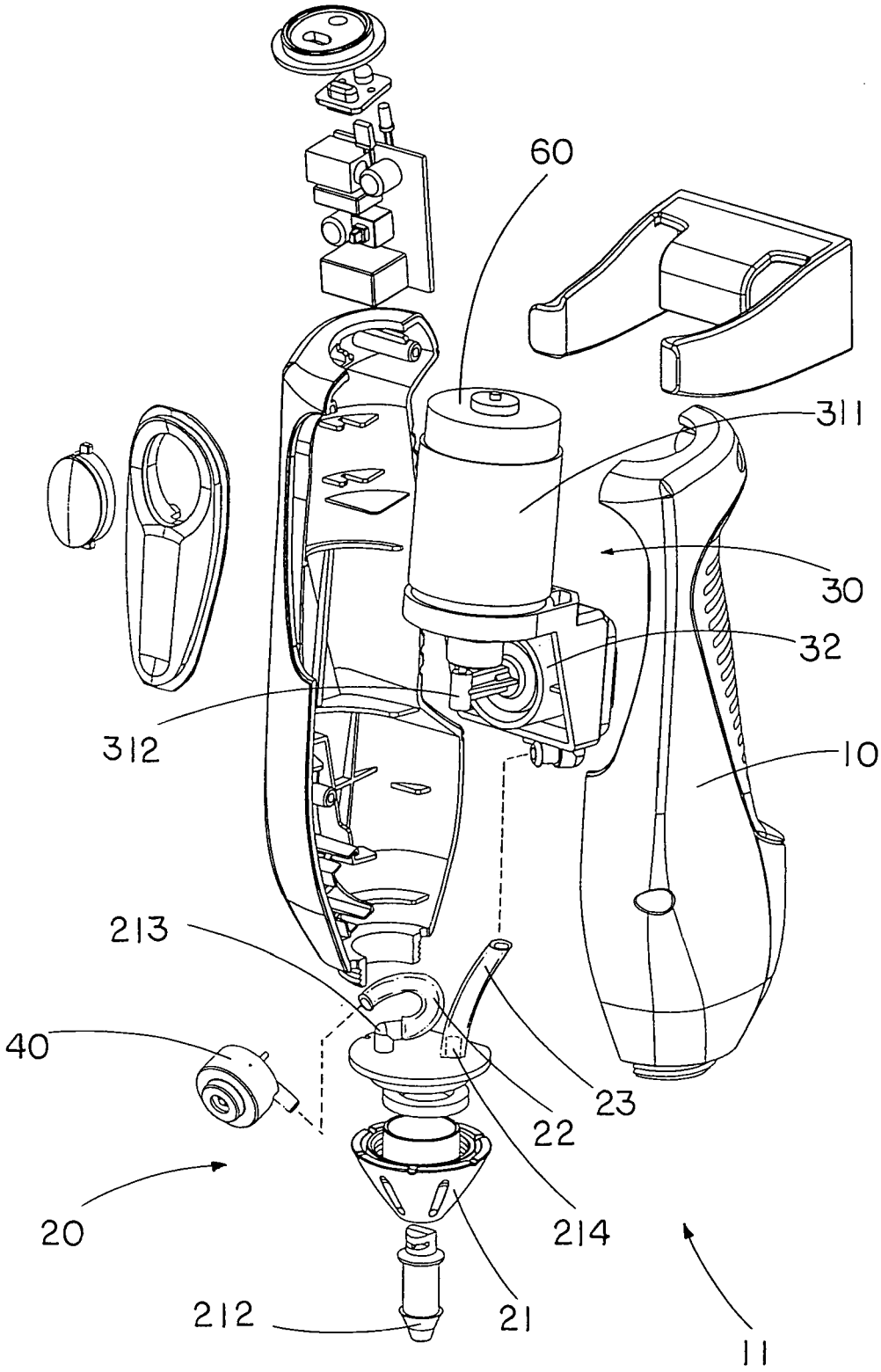
FIG. 1 is an exploded perspective view of a portable vacuum device according to a first preferred embodiment of the present invention.
Figure 2:
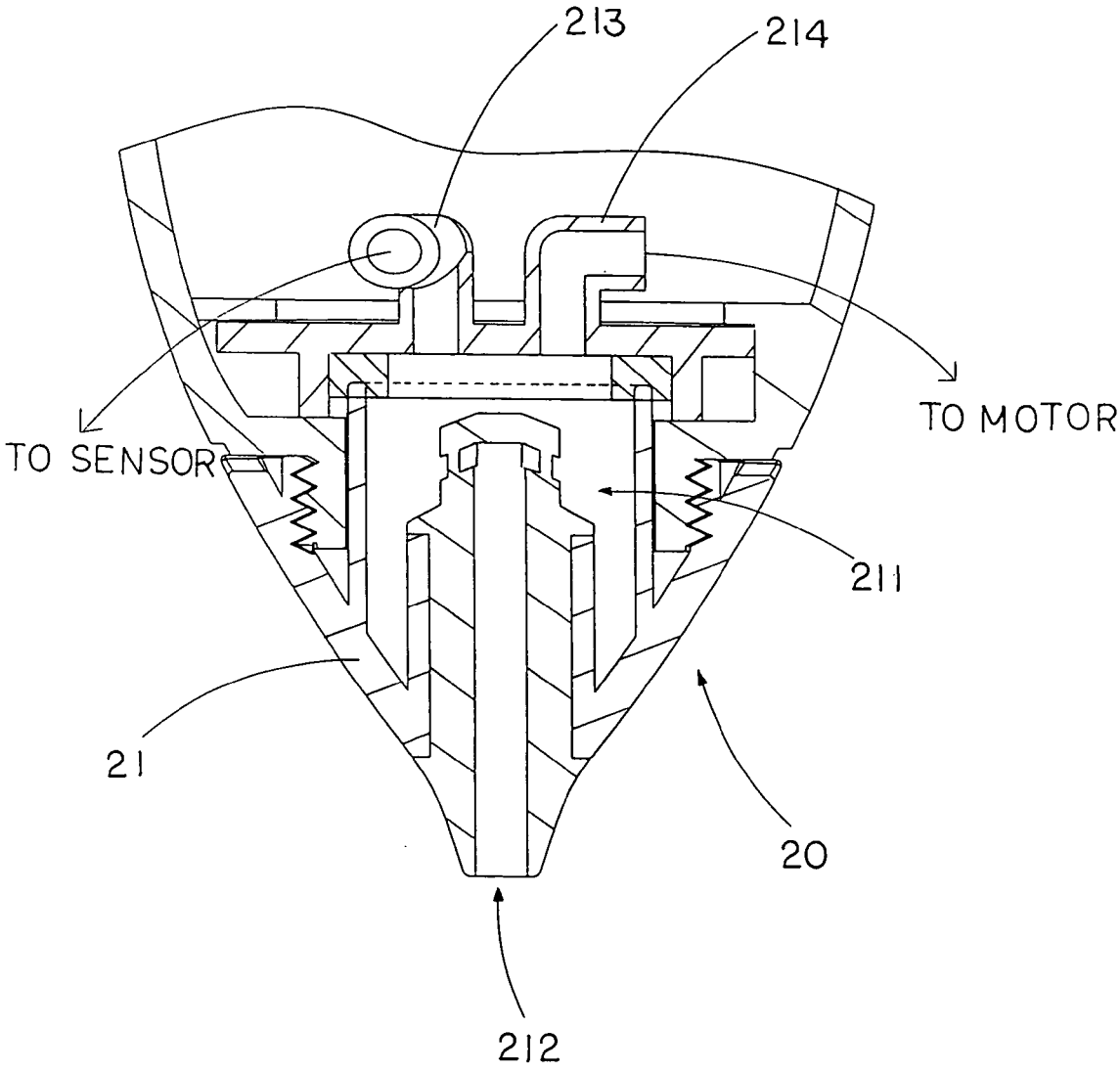
FIG. 2 is a partially sectional side view of the fluid extracting nozzle according to the above first preferred embodiment of the present invention.
Figure 5:
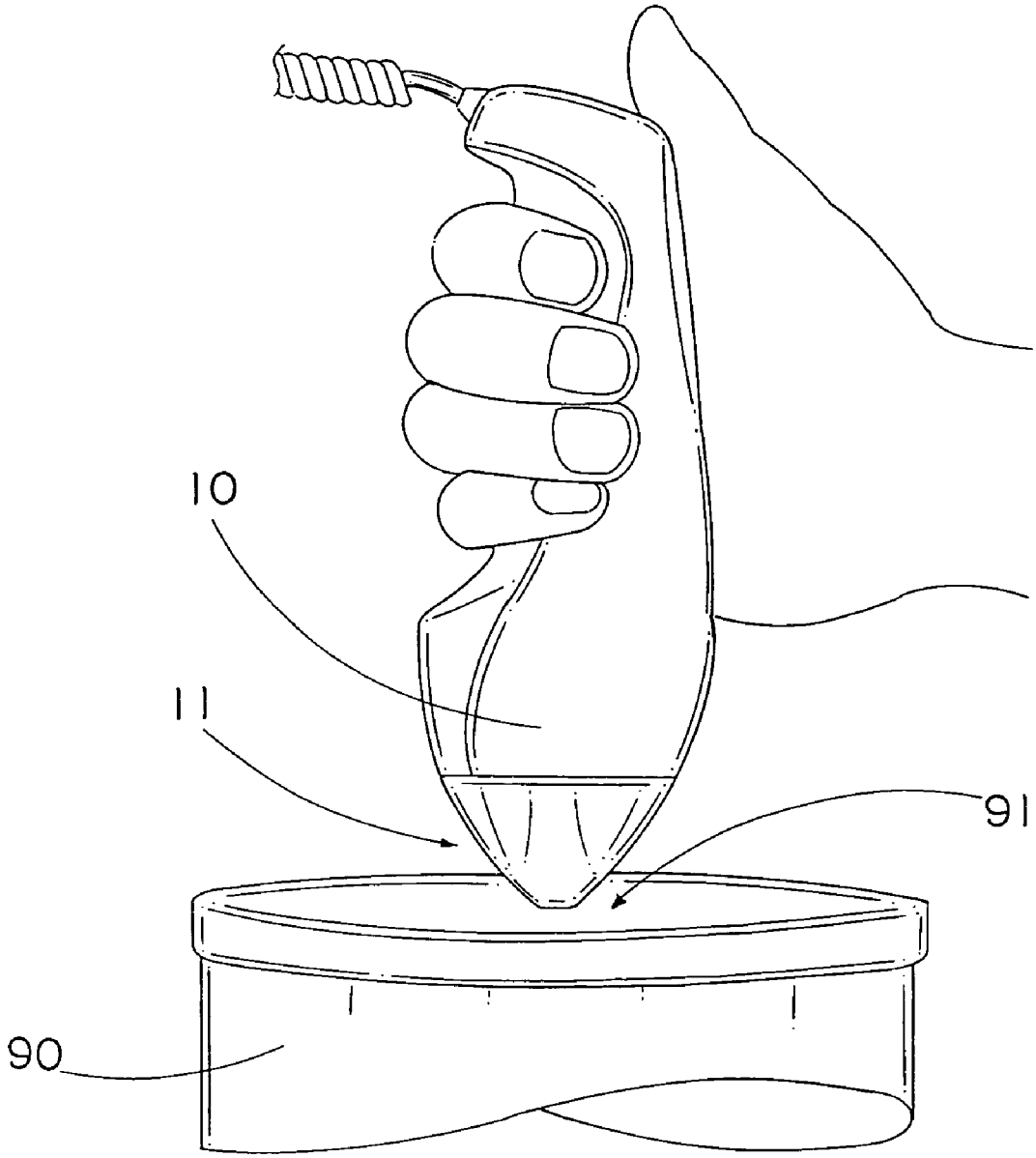
FIG. 5 is a schematic diagram of an operation of the portable vacuum device according to the above first preferred embodiment of the present invention.

Referring to FIG. 1, FIG. 2 and FIG. 5 of the drawings, a portable vacuum device for extracting fluid in a container 90 having an opening 91 according to a first preferred embodiment of the present invention is illustrated, in which the portable vacuum device comprises a handheld housing 10, a fluid extracting nozzle 20, a vacuum device 30, and means for sensing a vacuum pressure at the fluid extracting nozzle 20.

The handheld housing 10, which is made of durable and light materials, such as plastic materials, for portable and prolonged usage, has a vacuuming head 11 for communicating with the opening 91 of the container 90 such that fluids, especially air, inside the container 90 may be extracted by the vacuum device 30 through the opening 91 and the vacuuming head 11.

The fluid extracting nozzle 20, having a vacuum pressure corresponding to an interior pressure of the container 90, is extended towards the vacuuming head 11 for communicating with the opening of the container 90.

The vacuum device 30 is supported within the handheld housing 10 to generate a vacuum effect within the fluid extracting nozzle 20 at the vacuuming head 11 of the handheld housing 10 for extracting the fluid in the container 90.

The sensing means comprises a sensor switch 40, which is electrically connected between the vacuum device 30 and the fluid extracting nozzle 20 to sense the vacuum pressure at the fluid extracting nozzle 20, comprises a movable conductive member 41 driven with respect to the vacuum pressure of the fluid extracting nozzle 20, and two control members 42 normally positioned spacedly apart from the movable conductive member 41 to allow the vacuum device 30 to be operated, wherein when the vacuum pressure drops below a predetermined threshold pressure, the movable conductive member 41 is driven to electrically contact with the control members 42 to form an open circuit of the vacuum device 30 so as to deactivate the vacuum device 30 from generating the vacuum effect. In other words, the vacuum device 30 stops extracting the fluid inside the container. This scenario occurs, as will be elaborated in more detail below, when the fluid inside the container 90 is substantially extracted, thus causing gradual decrease of the vacuum pressure, and ambient atmospheric pressure then forces the movable conductive member 41 to move into contact with the control member 42.

Referring to FIG. 2 of the drawings, the fluid extracting nozzle 20 comprises a nozzle body 21 forming an enlarged vacuum chamber 211, and a fluid inlet 212 alignedly positioned at the vacuuming head 11 of the handheld housing 10 for communicating the vacuum chamber 211 with the interior pressure of the container 90 via the opening 91, wherein the vacuum device 30 creates the vacuum effect within the vacuum chamber 211 to generate the vacuum pressure therewithin corresponding to the interior pressure of the container 90 for extracting the fluid in the container 90 to the vacuum chamber 211. According to the first preferred embodiment of the present invention, the fluid inlet 212 is adapted for sealingly engaging with the container 90 so as to ensure proper and accurate vacuuming of the container 90.

Figure 3:
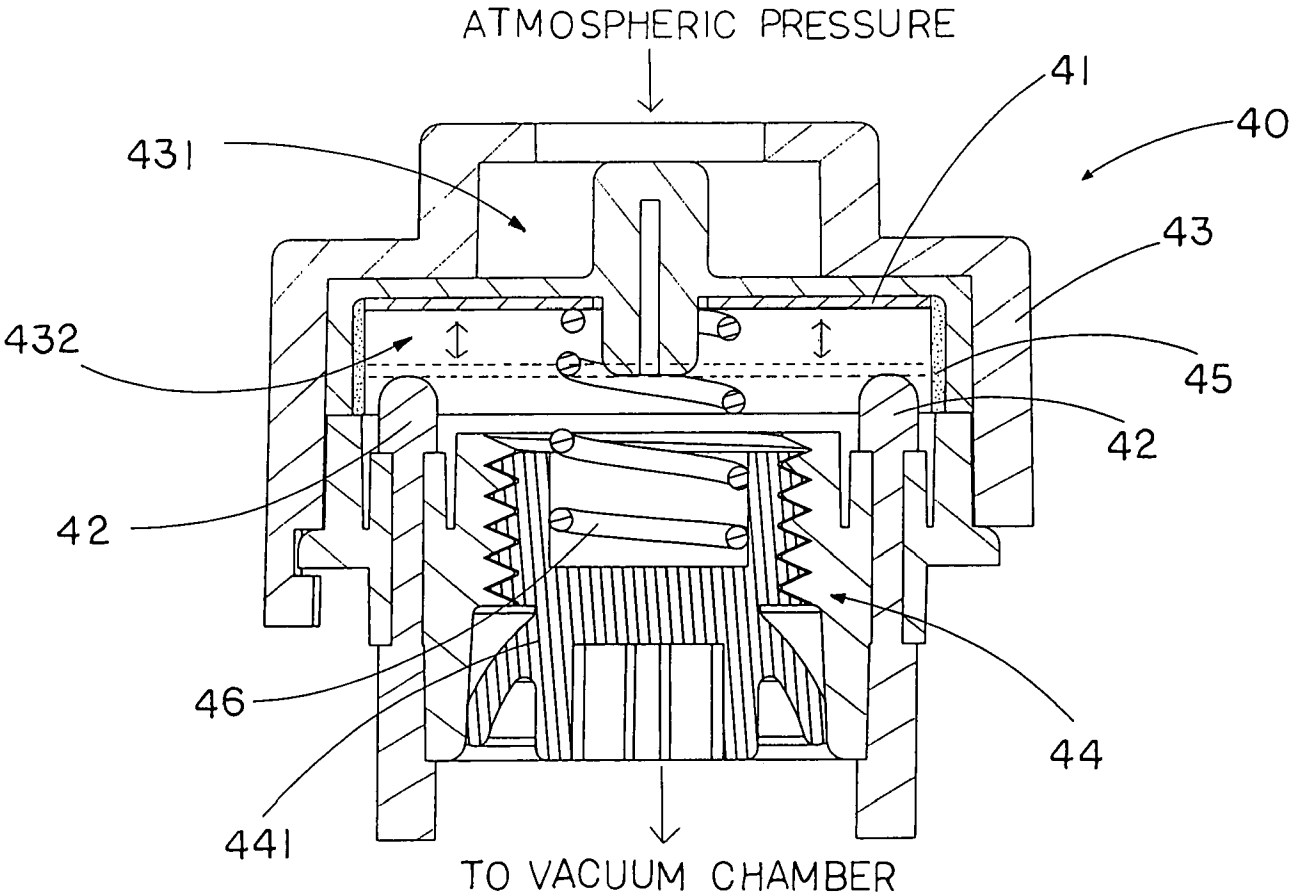
FIG. 3 is a partially sectional side view of the sensor switch according to the above first preferred embodiment of the present invention.

Referring to FIG. 3 of the drawings, the sensor switch 40 further comprises a sensor housing 43 having a pressure inlet 431 subject to a reference pressure, such as the normal atmospheric pressure, and a sealing chamber 432, subject to the vacuum pressure, communicated with the pressure inlet 431, wherein the movable conductive member 41 is movably disposed in the sealing chamber 432 for controlling an operation of the vacuum device 30 when a vacuum pressure drops below a predetermined pressure which indicates that the fluid in the container 90 is substantially extracted.

Moreover, the sensor switch 40 further comprises a sealing ring 45 coaxially affixed to an inner sidewall of the sensor housing 43 in a slidably movable manner so as to sealingly separate the sealing chamber 432 and the pressure inlet 431. In other words, the sealing ring 45 prevents the sealing chamber 432 from communicating with the atmosphere pressure through the pressure inlet 431 when the movable conductive member 41 slidably moves within the sealing chamber 432.

In other words, when the vacuum pressure is less than the reference pressure, the movable conductive member 41 is driven towards control member 42 until the movable conductive member 41 contacts with the control member 42 to deactivate the vacuum device 30.

As a result, the fluid extracting nozzle 20 further has a sensor outlet 213 and a pumping outlet 214 spacedly formed on the nozzle body 21 to communicate the vacuum chamber 211 with the sealing chamber 432 of the sensor switch 40 and to communicate the vacuum chamber 211 with vacuum device 30 respectively.

Specifically, the fluid inside the container 90 is extracted to pass through the vacuum chamber 21 so as to develop the vacuum pressure therewithin which is substantially equals with a fluid pressure inside the container 90. The fluid extracting nozzle 20 further comprises a sensor tube 22 sealingly connecting the sensor outlet 213 with the sensor switch 40, and a pumping tube 23 sealingly connecting the pumping outlet 214 with the vacuum device 30, such that fluid driven in the vacuum chamber 21 is to be communicated with the sensor switch 40 and the vacuum device 30 through the sensor tube 22 and the pumping tube 23 respectively.

According to the first preferred embodiment, the sensor tube 22 and the pumping tube 23 are made of light, flexible, yet durable materials so that the relative position of the vacuum device 30 and the sensor switch 40 can be flexibly and optimally adjusted to achieve a compact structure without depending on a single elongated flowing tube to communicate the components within the vacuum device.

The movable conductive member 41 is embodied as a boundary between the pressure inlet 431 and the sealing chamber 432 wherein an outer side of the movable conductive member 41 is subject to the reference pressure, while the inner side of the movable conductive member 41 is subject to the vacuum pressure. As a result, a pressure difference between the inner side and the outer side of the movable conductive member 41 would drive the movable conductive member 41 moving in a direction which has a lower fluid pressure, i.e. the towards the direction of the sealing chamber 432. Furthermore, the sealing chamber 432 is sealingly communicated with the vacuum chamber 211 of the nozzle body 21 of the fluid extracting nozzle 20 through the sensor tube 22 such that the vacuum chamber 211 and the sealing chamber 432 are subject to substantially the same vacuum pressure, which is the fluid pressure inside the container 90.

In order to optimally control the operation of the vacuum device 30, the sensor switch 40 further comprises a resilient element 46 securely supported in the sealing chamber 432 for normally applying an urging force against the movable conductive member 41 to push the movable conductive member 41 at a position that the movable conductive member 41 is sealed at the pressure inlet 431 when the vacuum pressure reaches the reference pressure such that the movable conductive member 41 is normally spaced apart from the control member 42 with respect to the reference pressure.

Furthermore, the sensor switch 40 further comprises a sensor adjustor 44 having a retaining seat 441 rotatably mounted on the sensor housing 43, wherein an end portion of the resilient element 46 is substantially mounted at the retaining seat 441 such that the sensor adjustor 44 is rotatably moved with respect to the sensor housing 43 to selectively adjust the urging force of the resilient element 46 against the movable conductive member 41 so as to adjust a sensitivity of the movable conductive member 41 of the sensor switch 40 in response to the vacuum pressure. According to the first preferred embodiment, the resilient element 46 which is embodied as a compressive spring is securely supported in the sealing chamber 432 for normally applying an urging force to the inner side of the movable conductive member 41 against the reference pressure. Thus, by selecting a suitable sensitivity by the sensor adjustor 44, a sensitivity of the sensor switch 40 in response to the vacuum pressure inside the container 90 can be adjusted so as to adjust a sensitivity of controlling an operation of the vacuum device 30, such that a greater reference pressure would drive the movable conductive member 41 to depress the sensor adjustor 44 and eventually contacting with the control member 42.

As a result, the sensor adjustor 44 allows the portable vacuum device of the present invention to be effectively utilized in a wide variety of environments, such as in a region where the local atmospheric pressure is slightly lower or higher than the normal atmospheric pressure because of the relative geographical altitude of that region.

Referring to FIG. 1 to FIG. 3 of the drawings, the vacuum device 30 comprises a motor assembly 31 and a vacuum pump 32 disposed in the handheld housing 10. The motor assembly 31 is operatively communicated with the vacuum pump 32 which is communicated with the vacuum chamber 211 for extracting air inside the container 90 through the fluid extracting nozzle 20.

The motor assembly 31 comprises a motor 311 and a driving shaft 312 eccentrically extended therefrom for driving the vacuum pump 32 to extract fluid from the container 90. The vacuum pump 32 thus comprises a pumping chamber 322 and a pumping piston 321 having a driving end 3211 connected with the driving shaft 312 of the motor assembly 31, and a pumping head 3212 movably received in the pumping chamber 322 in a reciprocal manner. The driving shaft 312 is driven by the motor 311 to rotate eccentrically thereabout so as to drive the pumping piston 321 moving reciprocally with respect to the pumping chamber 322 for creating pressure differentials between the pumping chamber 322 and the container 90 so as to extract fluid therefrom.

Referring to FIG. 3, FIG. 4A to FIG. 4C of the drawings, the vacuum pump 32 further comprises a valve unit 323 defining first and second fluid releasing cavities 3231 3232 which communicate with the pumping chamber 322 in a controlled manner through first and second fluid control valves 3233, 3234 respectively. The second fluid releasing cavity 3232 is communicated with an exterior of the portable vacuum device so that fluid flowing therein is arranged to be pumped out of the portable vacuum device for continuously creating the pressure differentials between the pumping chamber 322 and the container 90. In order to control fluid flowing into and out of the first and the second fluid releasing cavities 3231, 3232, the first and second fluid control valves 3233, 3234 are adapted to only allow unidirectional flow of the fluid to pass therethrough respectively.

According to the first preferred embodiment, the first fluid releasing cavity 3231 is communicated with the vacuum chamber 211 through the pumping tube 23 via the pumping outlet 214, wherein the first fluid control valve 3233 is adapted to allow unidirectional fluid flow from the first fluid releasing cavity 3231 to the pumping chamber 322. Conversely, the second fluid control valve 3234 is adapted to allow unidirectional fluid flow from the pumping chamber 322 to the second fluid releasing cavity 3232 which is then communicated to an exterior of the handheld housing 10.

Figure 4A:
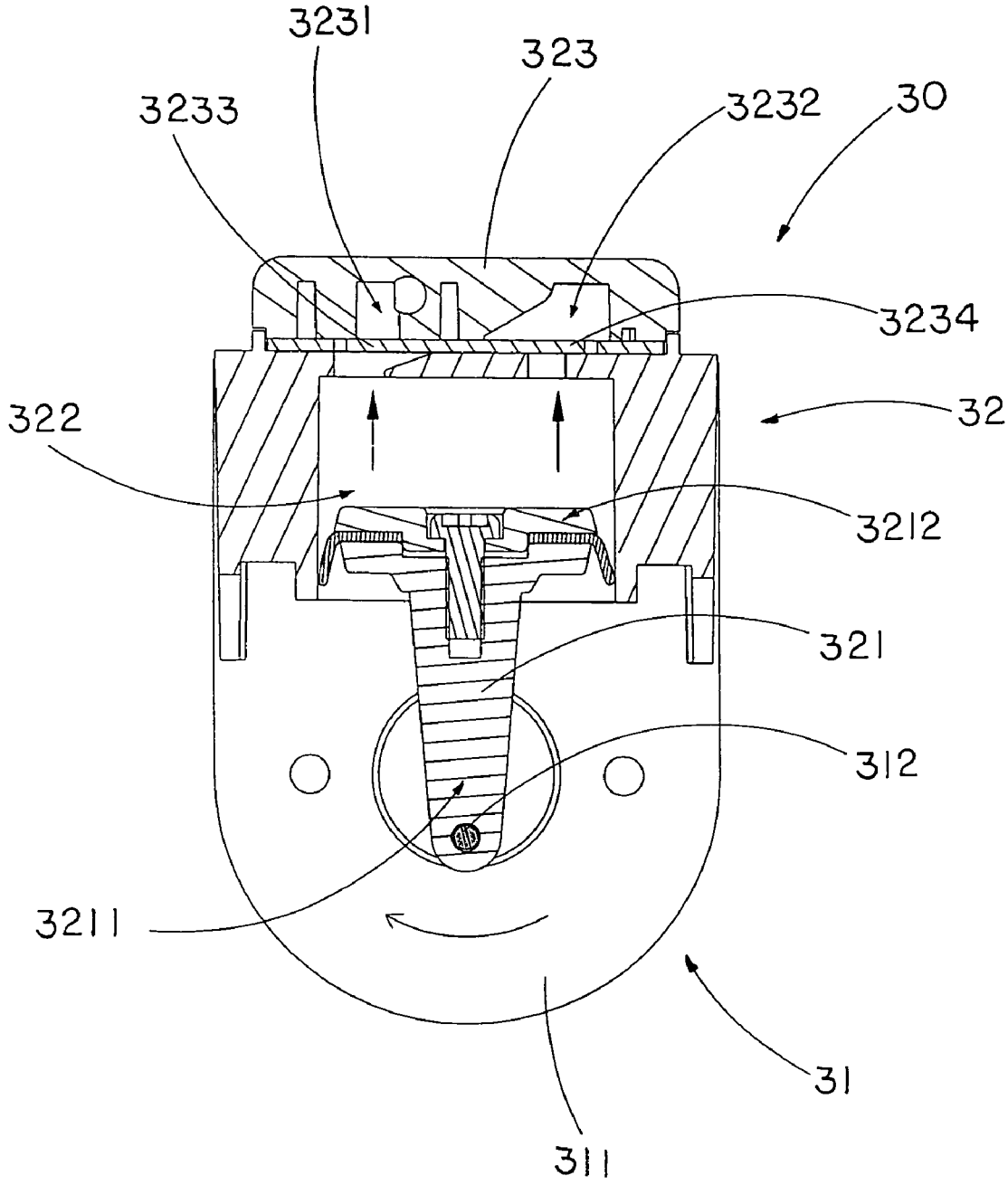
FIG. 4A to FIG. 4C are schematic diagrams of the operation of the vacuum pump according to the above first preferred embodiment of the present invention.

The operation of the vacuum pump 32 in association with the motor 31 is as follows: referring to FIG. 4A of the drawings, it illustrates a pre-pumping position of the motor 31 and the vacuum pump 32. At this position, intake of fluid to the pumping chamber 322 ceases to exist and fluid which has already existed in the pumping chamber 322 can only be pumped out of it through the second fluid control valve 3234 to the second fluid releasing cavity 3232.

Figure 4B:
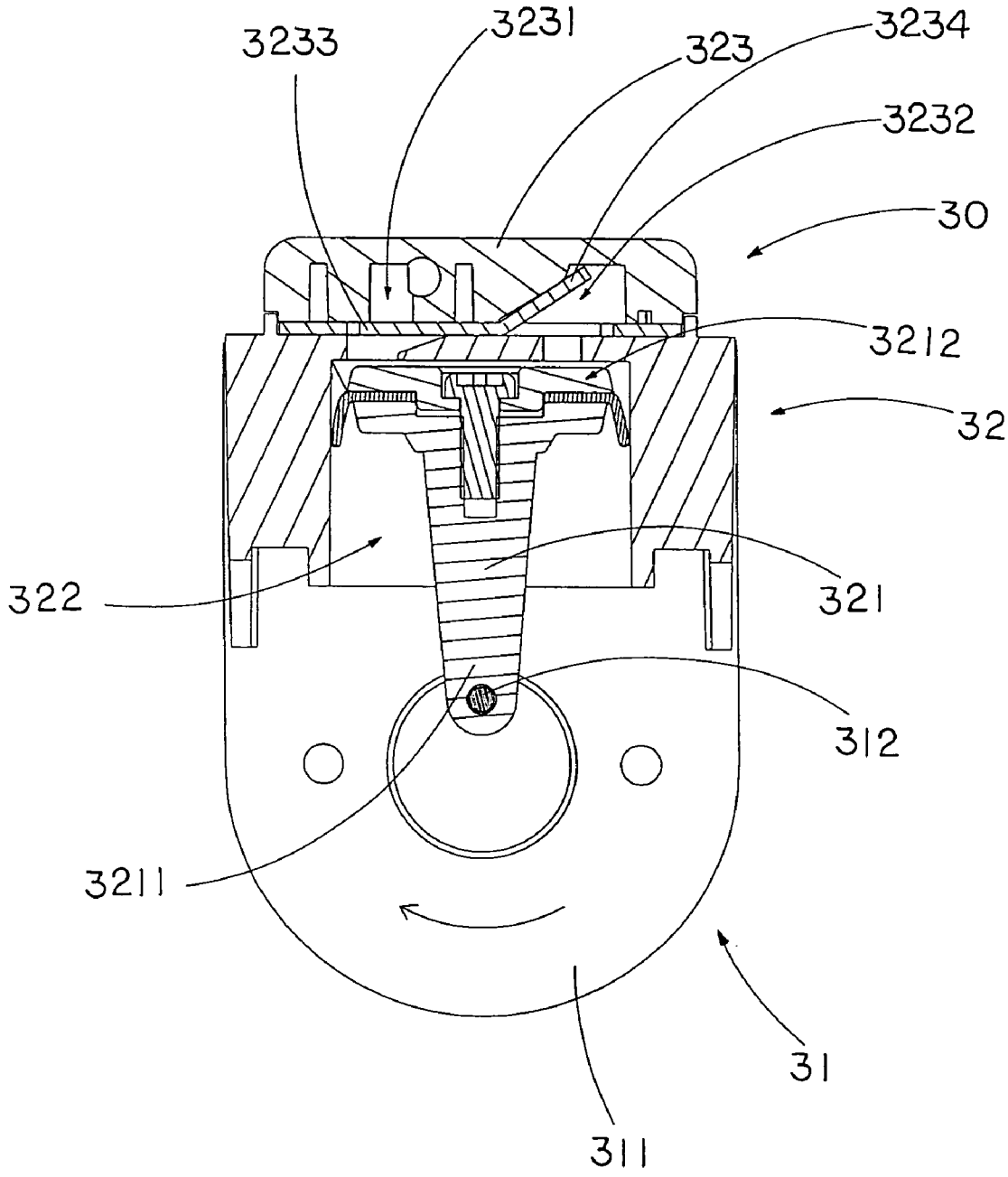

Referring to FIG. 4B of the drawings, it illustrates that the vacuum pump 32 is pumping out fluid from the pumping chamber 322. In this stage, the pumping piston 321 is driven to move towards the valve unit 323 so as to force fluid contained within the pump chamber 322 going out from the pumping chamber 322 through the second fluid control valve 3234 to reach the second fluid releasing cavity 3232, wherein the fluid is then released to the exterior of the handheld housing 10.

Figure 4C:
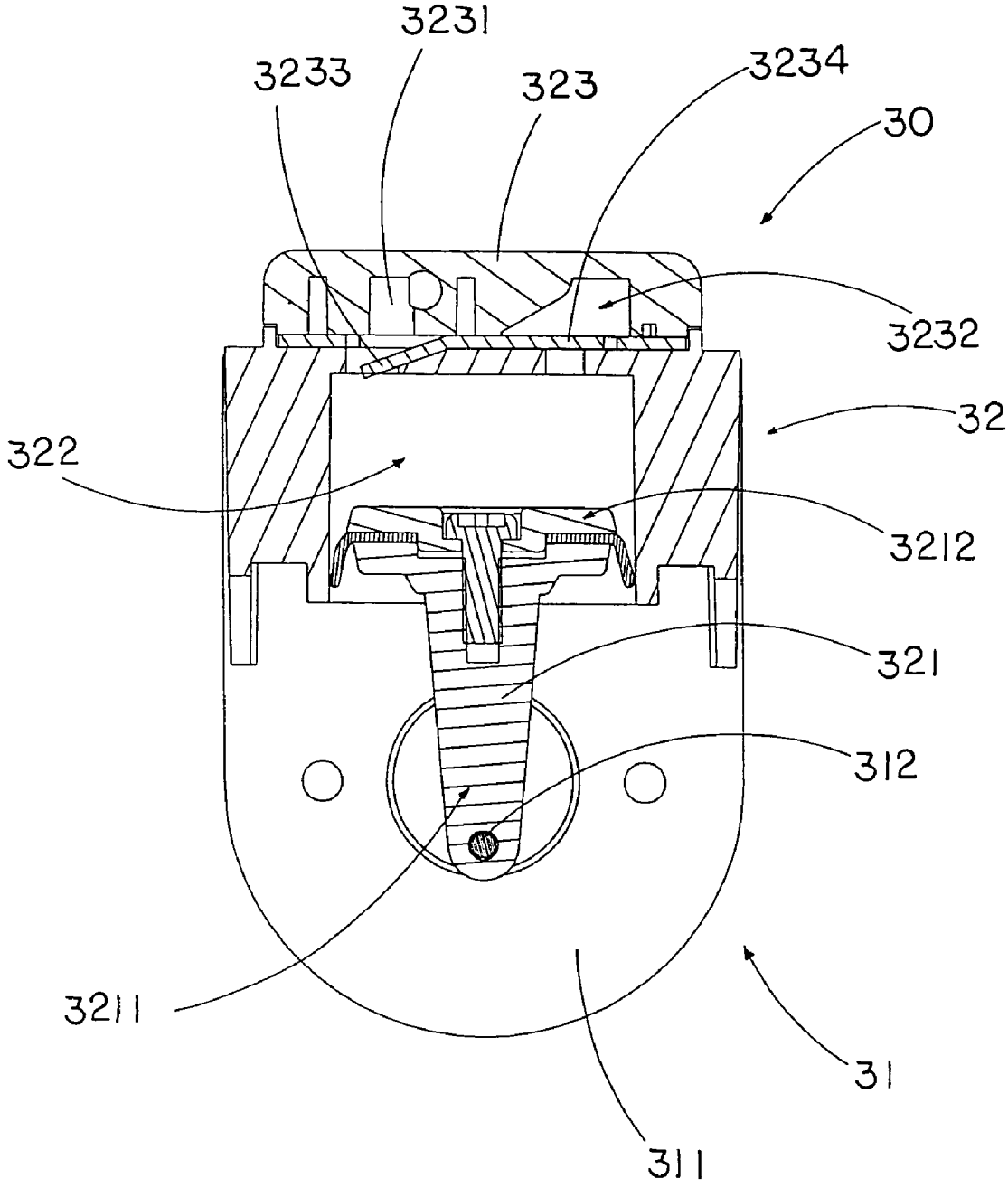

Referring to FIG. 4C of the drawings, it illustrates fluid intake by the vacuum pump 32 from the container 90. During this intake stage, the pumping piston 321 is driven away from the valve unit 323 for drawing fluid from the vacuum chamber 211 to reach the first gas releasing cavity 3231. In this scenario, the fluid is allowed to pass through the first fluid control valve 3233 for receiving in the pumping chamber 322. After the pumping piston 321 is driven back to its fullest extent, the pumping cycle continues by going through the FIG. 4A to the FIG. 4C all over again.

Note that when the pumping operation ceases to exist, and that when the fluid extracting nozzle 20 disengages with the opening 91 of the container 90, the vacuum pressure restores to the atmospheric pressure and the resilient element 46 is adapted to exert the normal urging force to the movable conductive member 41 so as to drive it back against the pressure inlet 431.

Thus one can appreciate that by controlling a rotational speed of the motor 311, the rate of pumping and the rate of extracting fluid from the container 90 can be effectively controlled.

Accordingly, as shown in FIG. 1 of the drawings, the portable vacuum device further comprises a control panel 50 operatively provided on the handheld housing 10 and electrically connected with the motor assembly 31 for controlling an operation of the motor assembly 31, such as on-off or the rate of extraction.

It is worth pointing point out that the portable vacuum device of the present invention is meant to achieve outdoors portable use, as well as indoors prolonged use. Thus, it further comprises a power supply unit 60 received in the handheld housing 10 and electrically connected with the motor assembly 31 and the control panel 50 so as to provide electrical power to the vacuum device 30 for its operation. The power supply unit 60 is preferably embodied as a rechargeable battery which is adapted to be recharged through a power inlet provided on the handheld housing 10 for independent use in a portable manner. Alternatively, the power supply unit 60 may be connected with an external AC power source for real time acquisition and utilization of electrical power.

From the forgoing descriptions, it can be appreciated that the relative positions of the vacuum device 30, the sensor switch 40, and the fluid extracting nozzle 20 are such that there is no single flow tube to effect the vacuuming operation of the present invention. Instead, by the virtue of the vacuum chamber 211 and the sensor tube 22 and the pumping tube 23, the relative position of the vacuum device 30 and the sensor switch 40 can be arranged to form a compact structure so as to minimize an overall size of the handheld housing 10. For instances, as shown in FIG. 5 of the drawings, the handheld housing 10 is designed and crafted to form an elongated structure for convenient use.

It is also important to point out that the sensor means may be embodied as any kind of sensor switch, such as magnetic switch, which may deactivate the vacuum device 30 from operating when the fluid inside the container 90 has been substantially extracted.

In order to utilize the portable vacuum device of the present invention, the user may simply need to engage the fluid extracting nozzle 20 with the opening 91 of the container 90, and then operate the control panel 50. After the fluid inside the container has been extracted, the sensor means would be able to stop vacuuming in the manner as mentioned above.

Figure 6:
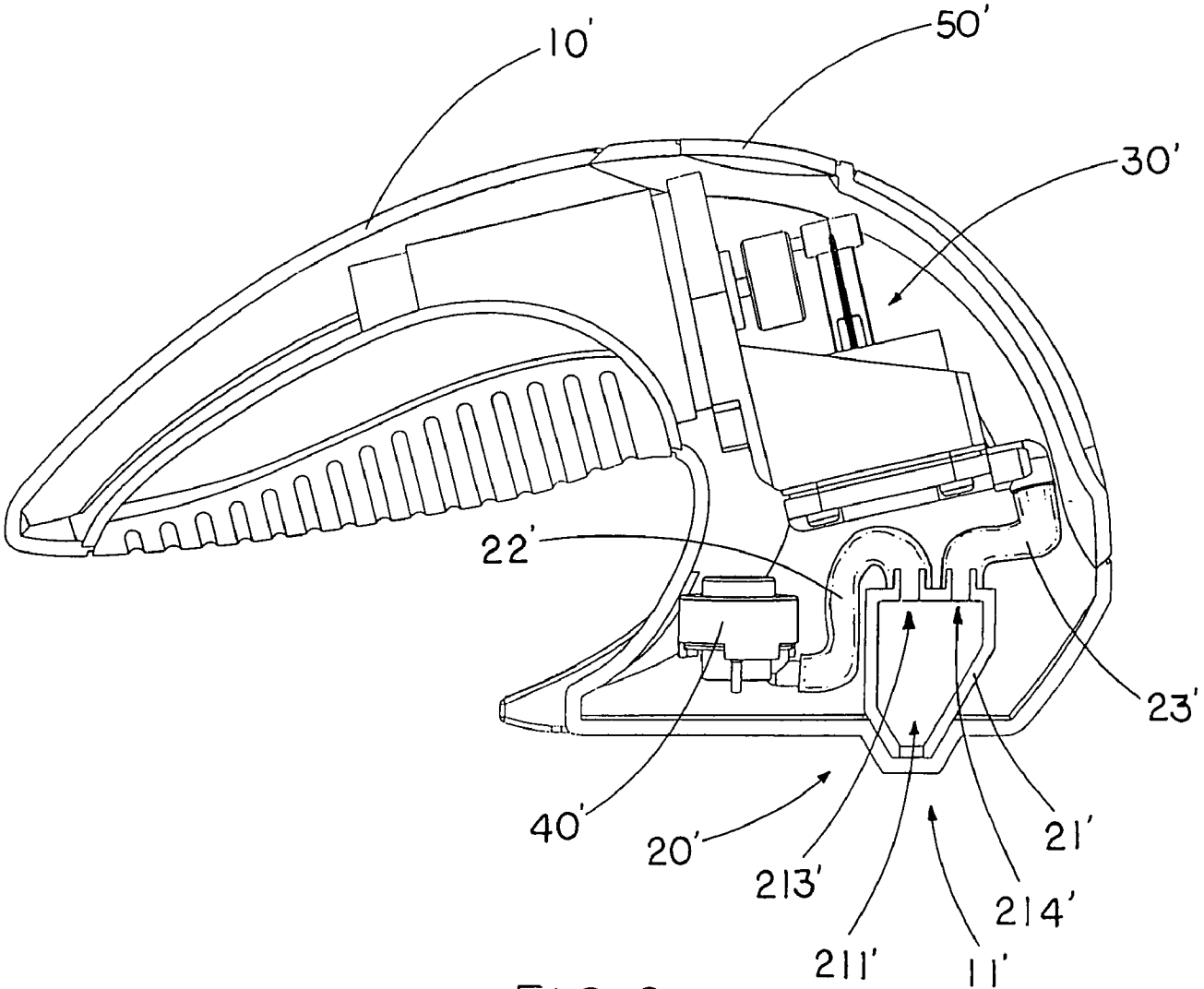
FIG. 6 is an alternative mode of the portable vacuum device according to a second preferred embodiment of the present invention.
Figure 7:
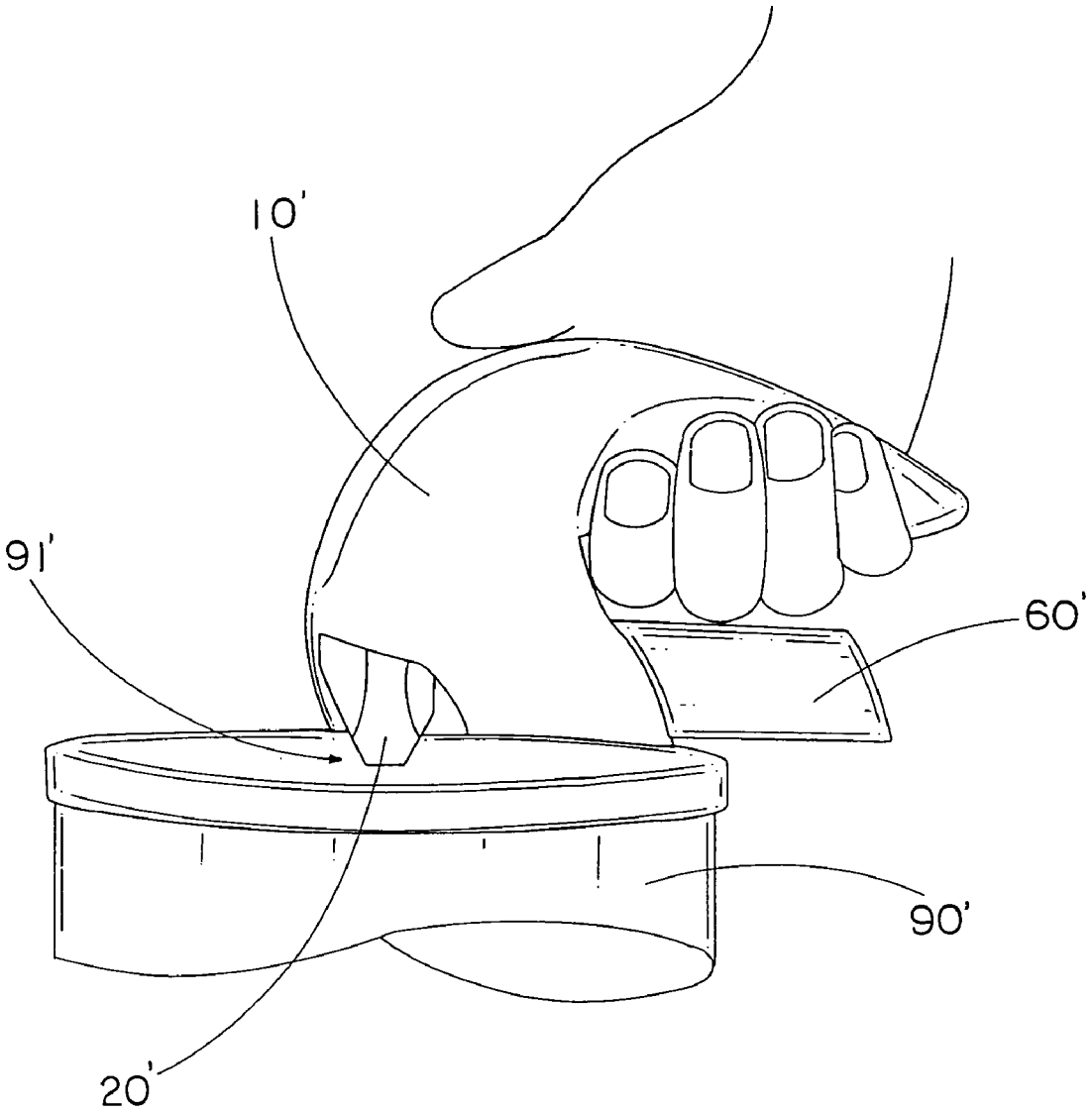
FIG. 7 is a schematic diagram of an operation of the portable vacuum device according to the above second preferred embodiment of the present invention.

Referring to FIG. 6 and FIG. 7 of the drawings, a portable vacuum device for extracting fluid in a container 90' having an opening 91' according to a second preferred embodiment of the present invention is illustrated, in which the portable vacuum device comprises a handheld housing 10', a fluid extracting nozzle 20', a vacuum device 30', and means for sensing a vacuum pressure at the fluid extracting nozzle 20'.

The handheld housing 10', which is made of durable and light materials, such as plastic materials, for portable and prolonged usage, has a vacuuming head 11' for communicating with the opening 91' of the container 90' such that fluids, especially air, inside the container 90' may be extracted by the vacuum device 30 through the opening 91 and the vacuuming head 11'.

The second preferred embodiment is similar to that of the first preferred embodiment except the relative position of the vacuum device 30' and the sensor switch 40'. According to the second preferred embodiment, the handheld housing 10' has an enlarged vacuuming head 11' wherein the sensor switch 40' and the fluid extracting nozzle 20' are positioned side-by-side within the handheld housing 10' in the vicinity of the vacuuming head 11'. On the other hand, the vacuuming device 30', notably the motor assembly 31, is positioned right above the fluid extracting nozzle 20'. As such, the overall height requirement of the handheld housing 10' can be minimized, so as to minimize an overall size of the entire handheld housing 10'. Specifically, as shown in FIG. 7 of the drawings, a handheld portion of the handheld housing 10' is transversely extended to form a curved structure so as to optimally achieve a sound ergonomic effect of the handheld housing 10'.

Thus, the fluid extracting nozzle 20', having a vacuum pressure corresponding to an interior pressure of the container 90', is extended towards the vacuuming head 11' for communicating with the opening of the container 90'.

The fluid extracting nozzle 20' further has a sensor outlet 213' and a pumping outlet 214' spacedly formed on the nozzle body 21' to communicate the vacuum chamber 211' with the sensor switch 40' and to communicate the vacuum chamber 211' with vacuum device 30' respectively through a sensor tube 22' and a pumping tube 23' respectively.

Moreover, the portable vacuum device further comprises a control panel 50' operatively provided on the handheld housing 10' and electrically connected with the vacuum device 30'.

Furthermore, it portable vacuum device further comprises a power supply unit 60' supported by the handheld housing 10' so as to provide electrical power to the vacuum device 30' for its operation. The power supply unit 60' is preferably embodied as a rechargeable battery which is adapted to be recharged through a power inlet provided on the handheld housing 10' for independent use in a portable manner. Alternatively, the power supply unit 60' may be connected with an external AC power source for real time acquisition and utilization of electrical power.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A portable vacuum device for extracting fluid in a container having an opening, comprising:

a handheld housing having a vacuuming head;

a fluid extracting nozzle extended towards said vacuuming head for communicating with said opening of said container, wherein said fluid extracting nozzle comprises a nozzle body having an enlarged vacuum chamber and a fluid inlet alignedly positioned at said vacuuming head of said handheld housing for communicating said vacuum chamber with an interior pressure of said container, a vacuum device supported in said handheld housing to generate a vacuum effect within said fluid extracting nozzle at said vacuuming head of said handheld housing for extracting said fluid in said container, wherein said vacuum device creates said vacuum effect within said vacuum chamber to generate a vacuum pressure therewithin for extracting said fluid in said container to said vacuum chamber; and a sensor switch, which is electrically connected to said vacuum device to sense said vacuum pressure at said fluid extracting nozzle, comprising a movable conductive member driven with respect to said vacuum pressure of said fluid extracting nozzle and a control member normally positioned spaced apart from said movable conductive member to allow said vacuum device to be operated, wherein when said vacuum pressure drops below a predetermined threshold pressure, said movable conductive member is driven to electrically contact with said control member to form an open circuit of said vacuum device so as to deactivate said vacuum device from generating said vacuum effect, wherein said sensor switch further comprises a sensor housing having a sealing chamber subject to said vacuum pressure and a pressure inlet which is communicating with said sealing chamber and subject to an atmospheric pressure as a reference pressure, wherein said movable conductive member is movably disposed in said sealing chamber in an air sealing manner such that when said vacuum pressure is less than said reference pressure, said movable conductive member is driven towards said control member until said movable conductive member contacts with said control member to deactivate said vacuum device, wherein said sensor switch further comprises a resilient element securely supported in said sealing chamber for normally applying an urging force against said movable conductive member to push said movable conductive member at a position that said movable conductive member is sealed at said pressure inlet when said vacuum pressure reaches said reference pressure such that said movable conductive member is normally spaced apart from said control member with respect to said reference pressure, wherein said sensor switch further comprises a sensor adjustor having a retaining seat rotatably mounted on said sensor housing, wherein an end portion of said resilient element is substantially mounted at said retaining seat such that said sensor adjustor is rotatably moved with respect to said sensor housing to selectively adjust said urging force of said resilient element against said movable conductive member so as to adjust a sensitivity of said movable conductive member of said sensor switch in response to said vacuum pressure, wherein said fluid extracting nozzle further has a sensor outlet and a pumping outlet spacedly formed on said nozzle body to communicate said vacuum chamber with said sealing chamber of said sensor switch and to communicate said vacuum chamber with vacuum device respectively, wherein said fluid extracting nozzle further comprises a flexible sensor tube sealingly extended from said sensor outlet to said sensor housing to communicate said vacuum chamber with said sealing chamber and a flexible pumping tube sealingly extended from said pumping outlet to said vacuum device to communicate said vacuum chamber with said vacuum device.

2. A portable vacuum device for extracting fluid in a container having an opening, comprising:

a handheld housing having a vacuuming head;

a fluid extracting nozzle extended towards said vacuuming head for communicating with said opening of said container, wherein said fluid extracting nozzle comprises a nozzle body having an enlarged vacuum chamber and a fluid inlet alignedly positioned at said vacuuming head of said handheld housing for communicating said vacuum chamber with an interior pressure of said container, a vacuum device supported in said handheld housing to generate a vacuum effect within said fluid extracting nozzle at said vacuuming head of said handheld housing for extracting said fluid in said container, wherein said vacuum device creates said vacuum effect within said vacuum chamber to generate a vacuum pressure therewithin for extracting said fluid in said container to said vacuum chamber; and a sensor switch, which is electrically connected to said vacuum device to sense said vacuum pressure at said fluid extracting nozzle, comprising a movable conductive member driven with respect to said vacuum pressure of said fluid extracting nozzle and a control member normally positioned spaced apart from said movable conductive member to allow said vacuum device to be operated, wherein when said vacuum pressure drops below a predetermined threshold pressure, said movable conductive member is driven to electrically contact with said control member to form an open circuit of said vacuum device so as to deactivate said vacuum device from generating said vacuum effect, wherein said sensor switch further comprises a sensor housing having a sealing chamber subject to said vacuum pressure and a pressure inlet which is communicating with said sealing chamber and subject to an atmospheric pressure as a reference pressure, wherein said movable conductive member is movably disposed in said sealing chamber in an air sealing manner such that when said vacuum pressure is less than said reference pressure, said movable conductive member is driven towards said control member until said movable conductive member contacts with said control member to deactivate said vacuum device, wherein said sensor switch further comprises a resilient element securely supported in said sealing chamber for normally applying an urging force against said movable conductive member to push said movable conductive member at a position that said movable conductive member is sealed at said pressure inlet when said vacuum pressure reaches said reference pressure such that said movable conductive member is normally spaced apart from said control member with respect to said reference pressure, wherein said sensor switch further comprises a sensor adjustor having a retaining seat rotatably mounted on said sensor housing, wherein an end portion of said resilient element is substantially mounted at said retaining seat such that said sensor adjustor is rotatably moved with respect to said sensor housing to selectively adjust said urging force of said resilient element against said movable conductive member so as to adjust a sensitivity of said movable conductive member of said sensor switch in response to said vacuum pressure, wherein said sensor switch further comprises a sealing ring coaxially affixed to an inner wall of said sensor housing to seal said movable conductive member in a slidably movable manner so as to sealedly prevent said sealing chamber from communicating with said atmosphere pressure through said pressure inlet when said movable conductive member slidably moves within said sealing chamber, wherein said fluid extracting nozzle further has a sensor outlet and a pumping outlet spacedly formed on said nozzle body to communicate said vacuum chamber with said sealing chamber of said sensor switch and to communicate said vacuum chamber with vacuum device respectively, wherein said fluid extracting nozzle further comprises a flexible sensor tube sealingly extended from said sensor outlet to said sensor housing to communicate said vacuum chamber with said sealing chamber and a flexible pumping tube sealingly extended from said pumping outlet to said vacuum device to communicate said vacuum chamber with said vacuum device.

3. The portable vacuum device, as recited in claim 2, further comprising a power supply which comprising a rechargeable battery supported in said handheld housing to electrically connect to said vacuum device and a control panel formed on said handheld housing to selectively control said vacuum device in an on and off manner.

* * * * *